US008834622B2

(12) United States Patent
Shaw

(10) Patent No.: US 8,834,622 B2
(45) Date of Patent: Sep. 16, 2014

(54) INVESTMENT CASTING

(76) Inventor: Richard Dudley Shaw, Orpington (GB)

( * ) Notice: Subject to any disclaimer, the term of this patent is extended or adjusted under 35 U.S.C. 154(b) by 30 days.

(21) Appl. No.: 13/544,486

(22) Filed: Jul. 9, 2012

(65) Prior Publication Data

US 2013/0174999 A1 Jul. 11, 2013

(30) Foreign Application Priority Data

Jul. 11, 2011 (GB) ..... 1111874.2

(51) Int. Cl.

| | |
|---|---|
| ***B22C 1/08*** | (2006.01) |
| ***B22C 1/00*** | (2006.01) |
| ***B22C 1/18*** | (2006.01) |
| ***B22C 9/00*** | (2006.01) |
| ***B22C 9/04*** | (2006.01) |

(52) U.S. Cl.

CPC . *B22C 1/00* (2013.01); *B22C 1/183* (2013.01); *B22C 9/04* (2013.01); *B22C 1/181* (2013.01)

USPC ..... 106/38.22; 106/38.2; 106/811; 106/812; 427/133; 427/372.2; 427/397.7

(58) Field of Classification Search

USPC ..... 106/38.2, 38.22, 811, 812; 427/133, 427/372.2, 397.7

See application file for complete search history.

(56) References Cited

U.S. PATENT DOCUMENTS

| | | | | |
|---|---|---|---|---|
| 5,022,920 | A | 6/1991 | Buntrock et al. | |
| 6,020,415 | A | 2/2000 | Guerra, Jr. | |
| 6,450,243 | B1 | 9/2002 | Shaw et al. | |
| 6,755,237 | B2 | 6/2004 | Duffey et al. | |
| 6,814,131 | B2 | 11/2004 | Vandermeer | |
| 6,991,022 | B2 | 1/2006 | Vandermeer et al. | |
| 7,004,230 | B2 | 2/2006 | Vandermeer et al. | |
| 7,048,034 | B2 | 5/2006 | Vandermeer et al. | |
| 8,263,512 | B2 * | 9/2012 | Fernando et al. | 501/95.2 |
| 2008/0210844 | A1 * | 9/2008 | Nycz et al. | 249/134 |
| 2011/0114279 | A1 * | 5/2011 | Scott | 164/24 |

FOREIGN PATENT DOCUMENTS

| | | | |
|---|---|---|---|
| CN | 101638324 A | | 8/2009 |
| CN | 101638324 A | * | 2/2010 |
| GB | 1410634 | | 10/1975 |
| GB | 2347143 A | * | 8/2000 |
| GB | 2347143 A | | 8/2008 |
| JP | 6-116477 A | * | 4/1994 |
| WO | 2007126895 A1 | | 11/2007 |

OTHER PUBLICATIONS

Lawson, Matthew, United Kingdom Patent Office Search Report, Dated Oct. 15, 2012, 5 pages, London.

* cited by examiner

*Primary Examiner* — Anthony J Green

(74) *Attorney, Agent, or Firm* — B. Craig Killough; Barnwell Whaley Patterson Helms

(57) ABSTRACT

The invention provides novel binder, slurry and dry mix compositions for use in the production of investment casting moulds. These compositions comprise water insoluble fibers and significant amounts of uncalcined clay. The compositions display favorable separation characteristics and short drying times. The moulds formed using the compositions have a favourable green strength and conform closely to the wax pattern on which the mould is coated. Also provided are methods of producing the compositions, methods of investment casting mould production utilising the compositions and investment casting coating shells produced using the compositions of the invention.

22 Claims, No Drawings

INVESTMENT CASTING

This United States utility application claims priority to and the benefit of United Kingdom patent application number 1111874.2 filed Jul. 11, 2011.

BACKGROUND OF THE INVENTION

The invention relates to improvements in and relating to the field of investment casting. Investment casting is a well known process and is widely used in the production of metallic products. The process of forming an investment casting mould involves the dipping of an expendable pattern, commonly a wax model, into a slurry comprising a refractory material and a binder followed by the model's removal from the slurry. A coat of the slurry remains upon the model. A stucco coating of dry powdered refractory material is applied to the wet slurry coating the model and the slurry coating is then either dried or allowed to dry. After the first slurry coating and stuccoed layer have dried, further layers may be added by repeating the dipping, stuccoing and drying process until a coating of desirable thickness and green strength has been created.

The finished coating, which commonly comprises a number of dried slurry and stucco layers, eventually forms the mould. After a final layer of the coating has been dried, the wax model and coating are heated and, as the wax model melts, it is eliminated from the coating leaving a coating shell. The coating shell is then fired in order to remove any volatile organic residues present and to stabilize the shell. The shell is stabilized by ceramic bonds formed by sintering. The mould formed by the firing of the shell may then be filled with molten metal. The molten metal is allowed to cool and solidify to form a cast conforming to the inside of the mould. The mould is then removed from the metal.

Of course, the slurry may be applied to the wax model by a method other than dipping, such as coating.

Customarily, slurries used in investment casting contain a refractory material and a binder. Environmental considerations dictate that the binder should be water-based rather than say alcohol based. Ethyl silicate has been used as a binder but its expense and associated environmental issues commonly preclude its use. Silica sols are used in binder compositions. Where silica sols are used, the time taken for the drying process is disadvantageously long.

A single stuccoed slurry layer, applied to a wax model in the course of investment casting, may take between 3-8 hours to dry. Where the model comprises recessed parts or other complex features, the drying time may be increased to 24 hours or more. In the production of a shell mould comprising a number of layers, the total drying time is between 12 hours and several days. This significantly increases the cost of the process.

Organic polymers have been incorporated into sol binder compositions in order to improve the drying times of slurry coats formed therewith, for example U.S. Pat. No. 6,020,415 discloses a binder composition comprising a latex polymer.

Soluble organic polymers commonly dissolve and 'wet out' of the mould. It has been found that the green strength of moulds produced using such polymers suffers as a result.

Steam permeation through the mould on heating may occur at temperatures of around 200° C., or for example during the elimination of the wax model. This may substantially reduce the green strength of the resulting mould by up to 50%.

The incorporation of fibers into slurries for use in investment casting mould production in order to reduce the cracking of the mould produced, is exemplified in GB 1410634 B in which a thixotropic dipping mixture comprising fibers, a dispersing agent, a refractory material and a binder is disclosed. The dipping mixture is said to reduce or obviate the cracking of the mould during the drying process.

The patent applications GB2350810, U.S. Pat. No. 6,450,243 and the related international patent application WO/2001/068291 disclose methods of investment casting which involve slurries comprising insoluble organic fibers.

During further testing it has become clear that there are problems associated with the binder and slurry compositions of the prior art. It is among the objects of the present invention to solve one or more of the following problems.

It has been noted that insoluble fibers added to a binder composition comprising a silica sol may separate from the binder by floating to the surface or sinking to the bottom of the sol. These fibers may also ball up/cluster. Some of the fibers' effectiveness may therefore be lost.

Foundry slurries for use in investment casting containing materials of widely disparate specific gravities need continual stirring or other agitation in order to remain evenly dispersed. Without such agitation the dense material in the slurry, for example the dense ceramic refractory materials, will separate from the less dense liquid slurry components. Mechanical failure of the agitation means or power failure of the source powering the agitation means can lead to rapid compaction and/or separation of slurry components. This separation will at least cause production delays and at worst cause the loss of a considerable quantity of expensive slurry.

The document GB 1410634 B discloses a thixotropic slurry which requires agitation for the fibers to remain evenly dispersed.

Suspension aids have been added to investment casting slurries in order to prevent the separation of dense and less dense components. One of the disadvantages of most suspension aids is that their addition to a slurry causes an increase in drying time of the coats made with that slurry. There is thus a tendency for a coat of the slurry to slump under the influence of gravity as it dries. The increased drying time for each coat can lead to a much longer and accordingly more expensive process.

The use of stable or calcined ceramics in binders and slurries is universal in the practice of investment casting. Such stable ceramic materials include calcined clays, artificially produced aluminas, mullites, naturally occurring zircons and fused silica. The stability of calcined materials arises due to the heat treatment process which they have undergone. This heat treatment is conducted at temperatures which are below the melting point of the material in question. The temperatures are however sufficient to cause the material to thermally decompose. This decomposition reaction involves the driving off of volatile fractions of the material. In the case of limestone calcination, the limestone (calcium carbonate) is heated to around 850° C. This heating drives off the volatile fraction of carbon dioxide gas leaving a more thermodynamically stable calcium oxide solid. This calcium oxide is the stable calcined product of the reaction. In other calcining processes, the heat treatment may bring about a phase transition from a less thermodynamically stable solid phase to a more thermodynamically stable solid phase. The skilled person would know that many solids such as ceramics, refractories and ores are capable of undergoing calcination processes. Uncalcined ceramics such as clays are not used in investment casting compositions since they would be expected to lead to shrinkage during the drying and heating of slurry coats due to loss of water.

SUMMARY OF THE INVENTION

The invention provides novel compositions for use in the production of investment casting moulds. These compositions comprise water insoluble fibers and uncalcined clay.

In one aspect, the invention provides an aqueous binder composition for use in the production of investment casting moulds, comprising a silica sol, water insoluble fibers and uncalcined clay. In another aspect the invention provides an aqueous slurry composition for use in the production of investment casting moulds, comprising a silica sol, water insoluble fibers, uncalcined clay and a refractory material. In a further aspect the invention provides a dry mix composition for preparing slurries or binders for use in investment casting mould production comprising water insoluble fibers, uncalcined clay and a refractory material.

It is noted above that the use of calcined slurry, binder or dry mix components is universal in the practice of investment casting mould production. Uncalcined clays would be expected to lead to shrinkage during the drying and heating of the slurry coats due to loss of water from, or thermal decomposition of the uncalcined clay. Surprisingly it has been found that when using slurries comprising substantial quantities of uncalcinated clays as well as water insoluble fibers, no shrinkage occurs. Without wishing to limit the scope of the invention, the fibers are thought to aid the release of water and gas from the uncalcined clay during the drying and heating process, thereby preventing the mould from cracking.

The uncalcined clay also acts as a suspension agent. Surprisingly, the incorporation of uncalcined clay into a slurry comprising a refractory material and water insoluble fibers does not increase the drying time of slurry coats. In fact the strength and drying times of the coatings are improved. This increase in strength is preserved in the fired moulds. The incorporation of uncalcined clay into the slurry binder or dry mix therefore aids in the preservation of a dispersed slurry whilst overcoming the problems of increased coat drying time associated with conventional suspension agents. Since uncalcined clays are cheaper than their heat treated or calcinated counterparts, the slurry provided by the present invention is therefore also much more economical than existing slurries. A further surprising advantage of the presence of the uncalcined clay in the slurry is that due to the uncalcined clay's very small particle size the slurry's penetration into deep slots and holes on the pattern is enhanced. This, when compared to slurries not comprising the uncalcined clay, produces a mould which conforms more closely to the pattern itself.

Furthermore, uncalcined clay surprisingly adheres particularly well to the intercoat stucco applied to each layer immediately after the dipping process. This aids in increasing the coat thickness, resulting in less coats being necessary for the completion of the mould.

DETAILED DESCRIPTION OF THE INVENTION

In a preferred embodiment of the invention the amount of uncalcined clay in the composition is greater than 10% by weight of the composition. Surprisingly, above this threshold, the suspensions obtained using the compositions have particularly good suspension properties.

Preferably the uncalcined clay content is between 10% and 50%, by weight of the compositions. More preferably the uncalcined clay content is between 30% and 40% by weight of the compositions.

Preferably, the binder and slurry compositions of the invention are not thixotropic.

The binder composition of the present invention, once evenly dispersed, remain evenly dispersed for at least 10 weeks and preferably at least 6 months.

The slurry compositions of the present invention, once evenly dispersed, remain evenly dispersed for at least 10 weeks and preferably at least 6 months The binder and slurry compositions of the invention preferably have a viscosity of between 10-60 seconds on a B4 cup.

The binder and slurry compositions of the invention more preferably have a viscosity of 15-40 seconds on a B4 cup.

Bentonite and Fuller's Earths are not suitable substituents for the uncalcined clay components of the compositions of present invention. Bentonite contains ions which are undesirable in ceramic moulds. Fuller's Earths are undesirable in the presence of Alumino Silicates.

The ceramic refractory material of the slurry or dry mix compositions of the invention may be selected from the group comprising calcined mullite, Mollochite-200 and fused silica and other refractory materials known to the person skilled in the art.

Preferably the water insoluble fibers of the compositions of the present invention have a denier of 3 to 20.

Preferably the water insoluble fibers are organic water insoluble fibers.

Preferably the water insoluble fibers' length to diameter ratio is between 25:1 and 100:1. More preferably the water insoluble fibers' length to diameter ratio is 50:1.

Preferably the uncalcined clay of the present invention is uncalcined china clay.

The compositions of the present invention preferably have the median group of their fiber lengths is the range 0.25-1.5 mm, and more preferably in the range of 0.5-1.5 mm.

In preferred embodiments, the water insoluble fibers of the binders, slurries or dry mix compositions of the invention may be selected from the group of polyester, nylon, polypropylene, acrylic, modified acrylic, viscose or rayon, carbon fibers, kermal-aramid fibers, Kevlar fibers or combinations thereof.

The water insoluble fibers may be ground to reduce their length prior to their incorporation in the binder, slurry or dry mix composition. The grinding means may be a mortar and pestle, a milling machine or other grinding means known in the art of grinding.

If the fibers have been ground they may be separated according to their length. A portion of the ground water insoluble fibers having a substantially desired length distribution may be retained and incorporated into the slurry. This separation may comprise at least one sieving step. The at least one sieving step may be an aerated sieving step. The sieving process preferably selects a range of fibers below a maximum value. The sieve selects fibers by allowing them to pass through apertures which have a largest width equal to the desired maximum fiber length. Inevitably, some fibers which pass through the apertures of the sieve will have a length greater than the preferred maximum length. This is because some fibers may pass through the sieve apertures lengthways rather than sideways. When it is stated hereafter that a quantity of fibers have a 'substantial distribution of their lengths' under a certain maximum value, it should be understood that this 'substantial' distribution refers to the fact that substantially all of the fibers have lengths under this maximum length. The only fibers which have lengths greater than this length are the ones which have unintentionally passed through the sieve. These may be regarded as superfluous and are less preferable than fibers below the maximum length.

The grinding process produces fibers having a wider distribution of lengths than the cutting process which has been used in the art to date.

Thus the water insoluble fibers of the compositions of the present invention may be obtainable by grinding and may be optionally selected according to their length.

Preferably the water insoluble fibers obtainable by grinding have, a substantial distribution of their lengths below a maximum length.

If the water insoluble fibers of the present invention have been ground as detailed above, they preferably have a substantial distribution of their lengths below the maximum lengths of 1 mm, 1.2 mm, or 1.5 mm.

The fibers and methods of forming fibers which are described in this specification may also be incorporated into compositions or methods of forming compositions which do not comprise or involve the use of uncalcined clay, These compositions are also suitable for forming investment casting moulds.

The slurry or binder compositions of the present invention are preferably stable with respect to separation for long periods of time, for example the time required to repair a broken agitation motor or to leave the slurry unagitated overnight.

The invention also provides a method of producing a mould for use in investment casting comprising:

i) coating an expendable pattern with one or more coats of a slurry comprising a composition as hereinbefore described, ii) drying said one or more coats or allowing said one or more coats to dry to form a shell.

The method may further comprise the steps of eliminating the expendable pattern and firing the shell.

The method may further comprise a step of diluting a dry mix composition according to the invention with a silica sol comprising from 15% to 50% silica.

In a further aspect the invention provides a method of preparing a composition of the invention for use in investment casting mould production comprising the step of providing water insoluble fibers and the step of providing an uncalcined clay.

The method may further comprise the step of grinding the water insoluble fibers to reduce their length.

The method may further comprise the steps of separating the ground, water insoluble fibers according to their length, retaining a portion of the ground, water insoluble fibers having a substantially desired length distribution and incorporating said portion into the composition.

The separation step of the method may comprise at least one sieving step.

The at least one sieving step may be an aerated sieving step.

The fibers in the retained portion of the water insoluble fibers may have a substantial distribution of their lengths below 1 mm, 1.2 mm, or 1.5 mm.

The method may further comprise the step of diluting a binder with water such that the silica sol has a silica concentration of below 50%.

Fiber grinding is a more economical process than the cutting process currently used in the art to prepare fibers of desired lengths. This allows the addition of more fiber for the same cost rendering the mould stronger and more permeable for the same cost.

Preferably, the apertures in the sieve used in the sieving step have a largest dimension equal to that of the desired fiber length.

The fibers described above may be selected such that the step of eliminating the expendable pattern from the coating shell does not cause the elimination of the fibers from the shell. Thus, where said pattern is to be eliminated by means of heating said shell to an elimination temperature which exceeds the melting point or sublimation temperature or decomposition temperature of said expendable pattern, said fibers may be selected such that the melting point of said fibers exceeds said elimination temperature. This will ensure that the fibers remain intact notwithstanding elimination of the pattern. The retention of said fibers in the shell will serve to maintain the green strength of the shell.

The slurries described above may comprise further ingredients, for modifying or improving the properties of the slurry. For example, said slurry may comprise an antifoaming agent, such as an antifoaming agent based on dimethylpolysiloxane.

In a preferred embodiment, the compositions of the invention comprise a 50% silica sol in water and polyester water insoluble fibers.

The refractory materials described above may be calcined mullite, Mollochite-200, fused silica, aluminosilicates, magnesia, zircon, and other heat stable refractory materials known to the man skilled in the art. Typically, the amount of refractory used in slurries of the invention may comprise 100-500% wt/wt, more preferably 100-200% wt/wt, still more preferably about 150% wt/wt of the binder component used.

The skilled person would understand that amounts of fiber or uncalcined clay other than those exemplified can be present in a given binder, slurry or dry mix composition. The amounts of these components which are suitable for the working of the invention will depend upon the amount of water (or other solvent) present in the composition as well as the length of the fibers used. The viscosity and the suspension characteristics are important properties which both depend upon these variables.

Also provided is a separation stable investment casting aqueous binder which comprises a silica sol and water insoluble fibers, wherein once evenly dispersed, the water insoluble fibers remain evenly dispersed for at least a week.

The separation stable investment casting binder preferably remains evenly dispersed for at least 6 months.

In the separation stable investment casting binder described above the specific gravity of the silica sol is preferably matched to, or above, the specific gravity of the water insoluble fibers.

Preferably the specific gravity of the fibers is above 1.38.

Preferably the silica sol is a 50% silica sol and the water insoluble fibers are polyester fibers.

Preferably the polyester fibers are at a concentration of 20 g/L and have lengths of 1.5 mm or a substantial distribution of their lengths below the maximum value of 1.5 mm.

Preferably the silica sol comprises silica particles in the size range of 32-35 nm.

Preferably the water insoluble fibers have a substantial distribution of their lengths below a maximum length.

Preferably the maximum length is 1.5 mm.

Where the separation stable investment casting binder is stable for at least a week, the silica sol may be a 50% silica sol when the water insoluble fibers are at a concentration of 20 g/L and have a substantial distribution of their lengths below a maximum length of 1.0 mm.

Also provided is a method of investment casting comprising the steps of any of the methods described above.

Also provided is a composition for use in the production of investment casting moulds, substantially as hereinbefore described with reference to the examples.

Also provided is an investment casting coating shell comprising a dried composition selected from any of the compositions described above.

Also provided is an investment casting mould comprising a heat treated coating shell.

The heat treatment commonly comprises the heating of the coating to a firing temperature. Typically, said firing temperature may be in the range from 800° C. to 1100° C. The skilled person would know however that firing temperatures outside this range may also be used.

EXAMPLES

Example 1

The following protocol for testing of the separation stability of fibers in binder sols was used:

a) 200 $cm^3$ of a sol of desired silica content was provided b) 20 gm/l (ie 4 g) of fibers were added to the sol. The container was closed and shaken to ensure an even initial fiber distribution.

c) The changes, if any, in the fiber distribution over time were observed.

Example 2

Nylon fibers were ground and sieved such that they had a distribution of lengths up to 1.2 mm. Using the protocol of example 1 and varying the amount of fibers added to the sol it was found that these fibers evenly dispersed at up to 40 g/L. In the length distribution of the fibers there are few fibers above 1.2 mm, most fibers are between 0.25 mm and 1 mm, the shorter fibers being more readily dispersed. A small amount of fibers of lengths above 1.2 mm will inevitably be present in the slurry since such fibers may pass lengthways rather than sideways through the apertures in the sieve.

Example 3

Using the protocol of example 1 and varying the amount of ground and sieved viscose fibers added (the fibers having a denier of 28 and range of lengths below 1.5 mm), it was found that it was possible to disperse the fibers at up to 40 g/L.

Comparative Example 4

Attempts to produce a silica sol comprising nylon fibers that stay evenly dispersed for significant periods of time were unsuccessful. Even dilution of the sol to 20% $SiO_2$ (where the specific gravity of sol is matched to the specific gravity of the fiber (1.14)) did not lead to a stable, even suspension. Even if a stable sol had been achieved at this dilution, few using current techniques would use such a dilute silica sol commercially.

Example 5

It was found that raising the silica content (and thus the specific gravity of the sol) of the sol compared to example 4 whilst at the same time substituting the nylon fibers for polyester resulted in stable solutions.

It is well established that at silica sols having a over 40% silica, the silica particle size must increase to preserve stability. For stability, a 50% sol requires 32-35 nm silica particles. A 50% silica sol has specific gravity of 1.38. which coincides with the specific gravity of polyester fiber.

It has been found that a 50% silica sol containing 20 g/L of 1.5 mm polyester fibers (formed by the state of the art cutting process) remains stable in excess of 6 months. Ground and sieved polyester fibers perform in the same way.

Comparative Example 6

Experiments have shown that the document GB 1410634 to ICI does not achieve the technical results which it purports to achieve. The mixture according to the GB 1410634 document proves difficult to use as it sloughs off and is very slow to dry.

Comparative Example 6A

The same procedure as in comparative example 6 was carried out using a slurry without the fibers and using a clay slip from Pottery Craft. The mixture was difficult to use. It sloughs off and is very slow to dry.

Comparative example 6B

A slurry was produced using the Pottery Craft clay slip used in example 6A. The clay slip was diluted with a 23% silica sol until it had a B4 cup viscosity of 28 s. This slurry produced a coating which appeared to be acceptable. However the coating then cracked on drying showing that such a slurry composition is not suitable for investment casting.

Example 7

A binder was made up by adding 20 g/L of ground polyester fibers (having a range of lengths below 1.0 mm) to a 50% silica sol. In practice, some of the fibers may be longer by virtue of their passing through the sieve lengthways rather than sideways. The resulting binder remained evenly dispersed for many weeks.

Example 7A

Increasing amounts of fibers (up to 90 g/L) were added to the binder produced in example 7. By the time 90 g/L of fibers had been added, the viscosity of the binder had increased to a B4 cup of over 100 s. It was found that an acceptable viscosity binder (comprising a high concentration of fibers) was produced when a 60 g/L of ground polyester having a range of lengths below 1 mm was added to the silica sol. This binder can then be diluted to a recommended value of 20 g/L of fibers by adding water.

Example 7B

During the dilution of the concentrated binder (in example 7A above) comprising 60 g/L of polyester fibers, the fibers and the sol separated, with some fibers sinking to the bottom of the container. In contrast, if nylon is used in the manufacture of a concentrated binder, the fibers separate by floating in both the concentrate and the diluted solutions. The sinking of fibers on the dilution of a solution is better than the situation where the fibers float. Floating fibers interfere with the dipping process since bodies to be dipped must break the surface of the slurry.

Example 8

Since it is difficult to add fibers to the binders of claim 6 (which comprised the clay slip) different binder mixtures were prepared. The preferred mix is as follows:

1 liter of a 50% silica sol 60 g 1 mm polyester.

500 g of the proprietary uncalcinated china clay.

This mixture does not display separation. The mixture diluted with 1 L of water. 3200 g of calcined (conventional) mullite was added to the composition.

The resulting slurry had a specific gravity of 1.9 and a B4 cup viscosity of 30 sec.

This slurry was used to coat wax models which had (for convenience) already been coated in a zircon base slurry. Four stuccoed coats were added. After 4 coats had been deposited, the thickness of the coating was deemed adequate for use in steel casting.

The coating shells were dewaxed in an autoclave. No cracking was observed despite the presence of the substantial amount of uncalcined clay. Each remaining shell was fired at at least 800° C. in line with conventional procedures. All but one of the moulds formed were carefully cut to examine the bonding between the stuccoed layers. Intercoat adhesion was good and there were no gross cracks. Under magnification, minute cracks were observed.

The experiment was repeated using molochite-200 and fused silica as the refractory material (instead of calcined mullite). The results were similar.

The experiment was also repeated with nylon rather than polyester fibers. The results were similar.

Example 9

The binders of experiment 8 were analysed prior to the addition of the refractory material (the calcined mullite). The binder composition was found to be 32% $SiO_2$ with 23.5% coming from the silica sol (1 L) and 8.5% coming from the uncalcined clay. One can conclude that a less concentrated silica binder sol may actually be used in conjunction with uncalcined clay since the uncalcined clay itself contributes to the binding ability of the binder.

Example 10

The shells in example 8 are very strong after dewaxing and firing.

Example 11

The slurry in 8 has been subjected to a stability test. After 10 days the slurry was stable and immediately usable without mixing. After 8 weeks of no stirring, part of slurry was remixed and viscosity remained at B4 cup of 30 s.

Example 12

Experiment 8 was reworked as follows:

Clay fiber and refractory material was prepared as a dry batch. Sols of varying $SiO_2$ content, from 50% down to 22% were prepared. Slurries of similar characteristics to Experiment 8 were produced. A dry mix comprising the dry ingredients of experiment 8 is useful.

Example 13

Experiment 8 was repeated using different amounts of clay. The beneficial effect of uncalcined clay was observed to be present in an amount as low as 5% of total solids. If the clay is in an amount over 50% of total solids, the slurry is not suitable for investment casting.

Example 14

A binder composition comprising small particle size silica sols was prepared.

A silica sol having 10/30 nm silica particles was diluted to 23% (a popular dilution). The specific gravity of the sol was 1.17.

An investment casting slurry comprising the following components was prepared:

i) 23% silica sol: 200 $cm^3$ (234 g)

ii) Nylon fibers (1 mm): 6 g iii) 100 g uncalcined China clay powder.

iv) 200 g of 200 mesh Mullite (50% $SiO_2$)

This mix, after proper wetting and mixing gave B4 cup viscosity of 65 seconds.

A modest addition of silica sol to this mix (225 ml (263 g)) reduced the viscosity to 31 seconds on a B4 cup.

Example 15

A binder mixture was made up comprising:

1170 g of a 24% silica sol and having an SG of 1.17. The sol contained 890 g $H_2O$ 22.25 g of 1000 μm polyester ground fiber.

500 g uncalcined china clay (30% by weight)

The binder mixture was homogeneous for long periods.

Example 16

A binder mixture was made up comprising:

1170 g of silica sol containing 24% $SiO_2$ and having an SG of 1.17. The sol contained 890 g $H_2O$.

26 g of 500 μm polyester ground fiber.

400 g uncalcinated china clay (25% by weight)

The binder had an SG of 1.27 a viscosity of 19 s on a B4 cup.

To the binder mixture were added 800 g of 200 mesh calcinated china clay (Molochite). The composition had an SG of 1.65 and a viscosity of 35 s on a B4 cup.

The composition produced had very little solid liquid separation over 48 hrs.

Example 17

A binder mixture was made up comprising:

1280 g (1 liter) of 35% silica sol.

20 g of 2.50 μm polyester ground fiber.

400 g of uncalcinated china clay (23% by weight)

This mixture remained homogeneous for in excess of 6 months.

Example 18

A binder mixture was made up comprising:

1380 g of 50% silica sol having an SG of 1.38

50 g of 250 μm nylon ground fibers.

500 g uncalcinated china clay (20% by weight)

500 g of 200 mesh calcinated china clay (Molochite).

This total, mixture remained homogeneous for in excess of 6 months and, was subsequently diluted with water to a preferred viscosity of 32 s on a B4 cup.

Example 19

The binder mixture of example 18 was prepared however no Molochite was added to the binder mixture. The mixture remained homogeneous.

Example 20

A dry mix was made up comprising:

1000 g of Calcinated china clay (Molochite)

500 g uncalcinated china clay 25 g of 1000 μm polyester fiber.

to this was added:

1 liter of 24% silica sol.

when this binder mixture was allowed to thoroughly wet in, it had a viscosity of 65 s on a B4 cup.

Subsequent additions of 50 $cm^3$ of 24% silica sol gave a viscosity of:

a) 40 s (for 1050 $cm^3$)

b) 35 s (for 1100 $cm^3$)

c) 30 s (for 1150 $cm^3$) measured on a B4 cup.

Example 21

A dry mix and binder composition were prepared according to example 20 however the calcinated to uncalcinated clay ratio was 3:1 rather than 2:1. To obtain a viscosity of 30 s on a B4 cup as in example 20(c) above, a further 200 $cm^3$ of the 24% silica sol was required. That is to say, in total 1200 $cm^3$ of the binder composition was produced.

Both of examples 20 and 21 were conducted as per examples 15 to 19.

The binder, the fiber and clay were prepared first and the molochite added thereafter. The results were very similar indicating that the method of mixing is not critical.

Examples 20 and 21 did take longer to thoroughly mix and de air.

Example 22

A binder composition was made up comprising:

1380 g of a 50% silica sol having an SG of 1.38. This sol contained 690 g of $H_2O$ 40 g of 500 μm ground polyester fiber.

400 g of uncalcinated china clay (21% by weight).

The percentage of fiber in sol was 2.9%. The percentage of fiber in $H_2O$ was 5.8%

The percentage of clay in sol was 28%. The percentage of clay in $H_2O$ was 57%

The mixture was homogeneous for in excess of 6 weeks.

Example 23

It was found that using polyester ground fibers of 1000 μm the same result was obtained as the recipe of example 22 with 27 g of fiber.

Example 24

To 500 $cm^3$ of each of the mixtures produced in examples 22 and 23, 500 g of calcinated clay were added. This gave a viscosity of 45 s on a B4 cup.

The mixture thus produced can readily be diluted to a viscosity of 30 s on a B4 cup with water for use. The resultant slurries remain homogeneous for periods in excess of 48 hours thus obviating the need for continuous mixing of the slurry.

What is claimed is:

1. A composition for use in the production of investment casting moulds, the composition comprising water insoluble fibers and uncalcined clay wherein the composition is an aqueous binder composition, which further comprises a silica sol; and wherein the amount of uncalcined clay in the composition is greater than 10% by weight of the composition, wherein the water insoluable fibers have a denier of 3 to 20.

2. The composition according to claim 1 wherein the uncalcined clay content is between 10% and 50by weight of the composition.

3. The composition according to claim 1 wherein the composition is not thixotropic.

4. The composition according to claim 1 wherein once evenly dispersed, the composition remains evenly dispersed for at least 10 weeks.

5. The composition according to claim 1 wherein the composition has a viscosity of between 10-60 seconds on a B4 cup.

6. The composition according to claim 1 wherein the composition further comprises a refractory material.

7. The composition according to claim 6 wherein the uncalcined clay content is between 10% and 50% by weight of the composition.

8. The composition according to claim 6 wherein the composition is not thixotropic.

9. The composition according to claim 6 wherein once evenly dispersed, the composition remains evenly dispersed for at least 10 weeks.

10. The composition according to claim 6 wherein the composition has a viscosity of between 10-60 seconds on a B4 cup.

11. The composition according to claim 6 wherein the refractory material is a ceramic refractory material selected from a group consisting of calcined mullite, 200 mesh calcinated china clay and fused silica.

12. The composition according to claim 1, wherein the uncalcined clay content is between 30% and 40% by weight of the composition.

13. The composition according to claim 1, wherein once evenly dispersed, the compositions remains evenly dispersed for at least 6 months.

14. The composition according to claim 1, wherein the composition has a viscosity of between 15-40 seconds on a B4 cup.

15. The composition according to claim 6, wherein the uncalcined clay content is between 30% and 40% by weight of the composition.

16. The composition according to claim 6, wherein once evenly dispersed, the composition remains evenly dispersed for at least 6 months.

17. The composition according to claim 6, wherein the composition has a viscosity of between 15-40 seconds on a B4 cup.

18. A dry mix composition for preparing slurries or binders for use in investment casting mould production, the composition comprising water insoluble fibers, uncalcined clay, and a refractory material and wherein the amount of uncalcined clay in the composition is greater than 10% by weight of the composition.

19. The dry mix composition according to claim 18 wherein the uncalcined clay content is between 10% and 50% by weight of the composition.

20. The dry mix composition according to claim 18, wherein the refractory material is a ceramic refractory material selected from a group consisting of calcined mullite, 200 mesh calcinated china clay and fused silica.

21. The dry mix composition according to claim 18, wherein the uncalcined clay content is between 30% and 40% by weight of the composition.

22. A method of producing a mould for use in investment casting comprising:

i) coating an expendable pattern with one or more coats of a slurry comprising a composition, the composition comprising water insoluble fibers and uncalcined clay wherein the composition is an aqueous binder composition, which further comprises a silica sol; and wherein the amount of uncalcined clay in the composition is greater than 10% by weight of the composition, ii) drying said one or more coats or allowing said one or more coats to dry to form a shell.

* * * * *